US005143640A

United States Patent [19]

Moxey

[11] Patent Number: 5,143,640

[45] Date of Patent: Sep. 1, 1992

[54] POLYETHER LUBRICANTS

[75] Inventor: John R. Moxey, Southampton, England

[73] Assignee: BP Chemicals Limited, London, England

[21] Appl. No.: 719,075

[22] Filed: Jun. 21, 1991

Related U.S. Application Data

[63] Continuation of Ser. No. 378,016, Jul. 11, 1989, abandoned.

[30] Foreign Application Priority Data

Jul. 21, 1988 [GB] United Kingdom ..... 8817415

[51] Int. Cl.[5] ..... C10M 145/34

[52] U.S. Cl. ..... 252/52 A; 252/52 R

[58] Field of Search ..... 252/52 A:52 R

[56] References Cited

U.S. PATENT DOCUMENTS 4,481,123 11/1984 Heutschel et al. ..... 252/52 R

FOREIGN PATENT DOCUMENTS 0246612 11/1987 European Pat. Off. .

0089695 5/1983 Japan ..... 252/52 A 0096698 6/1983 Japan ..... 252/52 A

*Primary Examiner*—Jacqueline Howard

*Attorney, Agent, or Firm*—Brooks Haidt Haffner & Delahunty

[57] ABSTRACT

An industrial or automobile lubricating oil, for use e.g. as automotive or industrial gear lubricants, two-stroke engine lubricants, comprises (a) 0 to 40% by weight of mineral oil(s) and (b) 100 to 60% by weight of a polyether having the general formula $RX[C_xH_{2x}O)_n(C_yH_{2y}O)_pH[_m$ wherein R is $C_9$ to $C_{30}$ alkyl or alkylphenyl, X is O, S or N, x is 2 to 4, y is 6 to 30, m is 1 or 2 and n and p are such that the polyether contains between 1 and 35% by weight of $(C_yH_{2y}O)$ units and between 35 and 80% by weight of $(C_xH_{2x}O)$ units. The polyether preferably has a molecular weight in the range 600 to 4000 and a viscosity in the range 32–460 mPa.s at 40° C.

9 Claims, No Drawings

POLYETHER LUBRICANTS

This application is a continuation of application Ser. No. 07/378,016, filed Jul. 11, 1989, now abandoned.

The present invention relates to new polyether automotive or industrial lubricating oils which are compatible with conventional mineral oils.

It is known from Japanese Kokai 50/133205 that polyethers having the general formulae $R^1—O—(AO)_n—R^2$ and $R^1—O—((AO)_m—CH_2—)(AO)_mR^1$ where $R^1$ and $R^2$ and $C_1$ to $C_{24}$ hydrocarbyl and/or hydrogen, m is 1 to 100, n is 1 to 50 and A is $C_pH_{2p}$ where p is 2 to 26, can be used as lubricating oils when mixed with mineral oils. In these formulations it is preferred that the mineral oil is the major component. However such materials tend to have excessive coefficients of shearing friction which makes them unsuitable for many applications.

U.S. Pat. No. 4,481,123 discloses a new polyalkylene glycol lubricant which is particularly suitable for use in power-transmission gears. Such lubricants are the products obtained by polymerising a $C_8$ to $C_{26}$ epoxide with tetrahydrofuran and a hydroxyl compound having the formula $H—OR^1$ in which $R^1$ denotes hydrogen, a $C_1$ to $C_{24}$ alkyl group or a $C_2$ to $C_{40}$ hydroxyalkyl radical. Typically, the lubricants have a molecular weight in the range 400 to about 1000, a kinematic viscosity at 40° C. of 5 to 3000 mPa.s and a viscosity index in the range from 150 to 220.

EP 246612 also describes a lubricating oil based upon a mixture of mineral oil and a polyether. Whilst the description indicates that the polyether is freely soluble in the mineral oil, only compositions in which 5 to 60% by weight of the polyether is present are taught as being advantageous. The polyether is one having the general formula $R[(C_nH_{2n}O)_x(C_mH_{2m}O)_yH]_z$ where R is a moiety derived from an organic starter, n is 2 to 4, m is 6 to 40, x and y are integer, z is 1 to 8 and the content of $(C_mH_{2m}O)$ groups in the polyether is 15 to 60% by weight.

EP 293715, which was published in December 1988, discloses lubricants containing monofunctional polyethers having an average molecular weight in the range 600–2500. The polyethers are prepared by alkoxylating a mixture of two types of monofunctional starter molecules namely $C_8$ to $C_{24}$ monalkanols and $C_4$ to $C_{24}$ alkyl substituted monophenols. The mineral oil content of the lubricant is suitably in the range 50 to 95% by weight.

The prior art described above generally teaches the desirability of using mineral oil/polyether lubricants only when the mineral oil constitutes the major component of the lubricant. It has now been found that certain selected polyethers are excellent lubricants for automotive and industrial applicants either in the absence of mineral oil or in mineral oil/polyether mixtures where the mineral oil comprises only the minor component.

According to the present invention there is provided an industrial or automotive lubricating oil composition characterised by it consisting essentially of:

(a) from 0 to 40% by weight of one or more mineral oils and (b) from 100 to 60% by weight of a polyether having the general formula.

$$RX[(C_xH_{2x}O)_n(C_yH_{2y}O)_pH]_m$$

wherein

R is either an alkyl or alkylphenyl group having from 9 to 30 carbon atoms

X is selected from O, S or N, x is 2 to 4 y is 6 to 30 m is 1 or 2 and n and p are such that the polyether contains between 1 and 35% by weight of $(C_yH_{2y}O)$ units and between 35 and 80% by weight of $(C_xH_{2x}O)$ units.

Considering the moiety R, this is suitably an alkyl or alkylphenyl group having from 9 to 30 carbon atoms. When R is an alkyl group it is preferably a $C_{10}$ to $C_{24}$ alkyl group, such as might be obtained from a corresponding fatty acid alcohol, thiol or amine. Most preferred are alkyl groups having 12 to 18 carbon atoms. In the case where R is alkylphenyl, R preferably has from 9 to 24 carbon atoms with phenyl groups substituted with one or more $C_6$ to $C_{12}$ alkyl groups being most preferred.

In addition to the moiety R and the group X the polyether is comprised of one or two oxyalkylene backbones independently of formula $[(C_xH_{2x}O)_n(C_yH_{2y}O)_pH]$. Such backbones are created by alkoxylating a starter molecule of formula $RX(H)_m$ with one or more alkylene oxides of formula $C_xH_{2x}O$ and $C_yH_{2y}O$. The alkoxylation can be carried out in a series of steps each employing a different alkylene oxide so that the backbone(s) formed comprise blocks of units of a given type. Alternatively the alkoxylation process can be carried out using a mixture of alkylene oxides in which can the backbones formed will comprise a random distribution of the units. For each of the two types of alkylene oxide, $C_xH_{2x}O$ and $C_yH_{2y}O$, one or more different alkylene oxides can be used. The only constraint is that in the final polyether, the total number of units having the formula $C_xH_{2x}O$ should comprise between 35 and 80% by weight and the total number of units having the formula $C_yH_{2y}O$ should comprise 1 to 30% by weight.

It is preferable that the units of formula $(C_xH_{2x}O)$ are mainly, i.e. greater than 50 mole %, comprised of oxypropylene $(C_3H_6O)$ units. Most preferred are those polyethers where the $C_xH_{2x}O$ groups are exclusively oxypropylene. As regards the $(C_yH_{2y}O)$ units these are preferably such that y is in the range 12–16.

The polyethers described above suitably have a molecular weight in the range 400 to 4000, preferably 500 to 3000. They are also characterised by having a viscosity in the range 32 to 460 mPas at 40° C.

With the above constraints in mind it is most preferred that the polyether has the formula defined above with n being in the range 5 to 30 and p being in the range 1 to 4.

The industrial and automotive lubricating oil of the present invention consists essentially of the polyether defined above optionally together with one or more mineral oils, including both napthenic and paraffinic oils, and optional additives such as pour point depressants, detergent additives, anti-wear additives, extreme pressure additives, anti-oxidants, anti-corrosion and anti-foam agents etc. According to an embodiment of the invention there is provided a process for preparing such a lubricating oil by blending up to 40% by weight of one or more mineral oils with 60% or more of the polyether.

The industrial and automotive lubricating oils of the present invention are particularly suitable as automotive gear and crankcase lubricants, two stroke engine lubricants, and industrial gear lubricants. The lubricating oils can also be used as transmission fluids in automobiles. In a further embodiment of the present invention there is provided a process for lubricating the moving parts of industrial plant or of automobiles characterised by applying a lubricating oil of the type defined above to the moving parts.

The following Examples illustrate the invention.

EXAMPLE 1

129 Grams of Dodecylphenol, catalyzed by adding 3.4 grams of Potassium Hydroxide and vacuum stripping the water of reaction, was reacted in Xylene (280 ml) at 135° C. and 50 psi with 1096 grams of an 88/12 wt/wt mixture of Propylene Oxide and Dodec-1-ene Oxide to a theoretical molecular weight of 2,500. The catalyst was removed by treatment with Magnesol (Magnesium Silicate), vacuum stripping and filtration, to yield 1225 grams of an oil soluble polyalkylene glycol having the composition given below, and on which the following data were determined.

| | | |
|---|---|---|
| Composition (% wt) | Dodecylphenol | 10.5 |
| | Propylene Oxide | 78.8 |
| | Dodec-l-ene Oxide | 10.7 |
| Viscosity (ASTM D445) mPa.s @ 40° C. | | 169 |
| mPa.s @ 100° C. | | 23.9 |
| Viscosity Index (ASTM D2270) | | 174 |
| Four Ball Wear Scar, Neat (IP239) 1 Hour, 40 Kg, mm | | 0.47 |

Miscibility, Mineral Oil, 25° C.

| PAG:BASE OIL | BP BASE OIL 150 TQ | BP BASE OIL 150 N | BP BASE OIL 80 BHK |
|---|---|---|---|
| 80:20 | complete (1) | complete (1) | complete (1) |
| 50:50 | complete (1) | complete (1) | complete (1) |

Note (1) complete = clear and complete solution.

EXAMPLE 2

213 Grams of Dodecylphenol, catalyzed by adding 5.6 grams of Potassium Hydroxide and vacuum stripping the water of reaction, was reacted in Xylene (280 ml) at 135° C. and 50 psi with 1004 grams of an 88/12 wt/wt mixture of Propylene Oxide and Dodec-1-ene Oxide to a theoretical molecular weight of 1500. The catalyst was removed by treatment with Magnesol (Magnesium Silicate), vacuum stripping and filtration, to yield 1217 grams of an oil soluble polyalkylene glycol having the composition given below, and on which the following data were determined.

| | | |
|---|---|---|
| Composition (% wt) | Dodecylphenol | 17.5 |
| | Propylene Oxide | 72.6 |
| | Dodec-l-ene Oxide | 9.9 |
| Viscosity (ASTM D445) mPa.s @ 40° C. | | 123 |
| mPa.s @ 100° C. | | 16.1 |
| Viscosity Index (ASTM D2270) | | 139 |
| Four Ball Wear Scar, Neat (IP239) 1 Hour, 40 Kg, (mm) | | 0.54 |

Miscibility, Mineral Oil, BP Base Oil 150TQ (90% polyalkylene glycol, 10% oil, 25° C.) clear, complete solution (50% polyalkylene glycol, 50% oil, 25° C.) clear, complete solution.

BP Base Oil 80BHK (90% polyalkylene glycol, 10% oil, 25° C.) clear, complete solution (50% polyalkylene glycol, 50% oil, 25° C.) clear, complete solution.

EXAMPLE 3

174 Grams of Dodecylphenol, catalyzed by adding 4.6 grams of Potassium Hydroxide and vacuum stripping the water of reaction, was reacted in Xylene (280 ml) at 135° C. and 50 psi with 1153 grams of an 88/12 wt/wt mixture of Propylene Oxide and Dodec-1-ene Oxide to a theoretical molecular weight of 2000. The catalyst was removed by treatment with Magnesol (Magnesium Silicate), vacuum stripping and filtration, to yield 1327 grams of an oil soluble polyalkylene glycol having of the composition below, and on which the following data were determined.

| | | |
|---|---|---|
| Composition (% wt) | Dodecylphenol | 13.1 |
| | Propylene Oxide | 76.5 |
| | Dodec-l-ene Oxide | 10.4 |
| Viscosity (ASTM D445) mPa.s @ 40° C. | | 147 |
| mPa.s @ 100° C. | | 20.0 |
| Viscosity Index (ASTM D2270) | | 157 |
| Four Ball Wear Scar, Neat (IP239) 1 Hour, 40 Kg, (mm) | | 0.54 |

Miscibility, Mineral Oil, BP Base Oil 150TQ (90% polyalkylene glycol, 10% oil, 25° C.) clear, complete solution (50% polyalkylene glycol, 50% oil, 25° C.) clear, complete solution.

EXAMPLE 4

250 Grams of Softanol AP30 (a 3 mole propoxylate of a C-12/14 linear secondary alcohol manufactured by Nippon Shokubai Kagaku Kogyo Co. Ltd.), catalyzed by adding 8.2 grams of Potassium Hydroxide and vacuum stripping of the water of reaction, was reacted at 115° C. and 50 psi with 1356 grams of a 79/21 wt/wt mixture of Propylene Oxide and Dec-1-ene Oxide to a theory molecular weight of 2,400. The catalyst was removed by treatment with Nagnesol (Magnesium Silicate), vacuum stripping and filtration, to yield 1606 grams of an oil soluble polyalkylene glycol with the composition below, on which the following data were determined.

| | | |
|---|---|---|
| Composition (% wt) | Secondary C-12/14 alcohol | 8.3 |
| | Propylene Oxide | 74.0 |
| | Dec-l-ene Oxide | 17.7 |
| Viscosity (ASTM D445) mPa.s @ 40° C. | | 132 |
| mPa.s @ 100° C. | | 21.3 |
| Viscosity Index (ASTM D2270) | | 188 |
| Four Ball Wear Scar, Neat (IP239) 1 Hour, 40 Kg, (mm) | | 0.49 |

| PAG:BASE OIL | BP BASE OIL 150 TQ | BP BASE OIL 150 N | BP BASE OIL 80 BHK |
|---|---|---|---|
| 80:20 | complete (1) | complete (1) | complete (1) |
| 50:50 | complete (1) | complete (1) | complete (1) |

Note (1) complete = clear and complete solution.

EXAMPLE 5

324 Grams of Softanol AP30 (3 mole propoxylate of a C-12/14 linear secondary alcohol manufactured by Nippon Shokubai Kagaku Kogyo Co. Ltd) catalyzed by adding 10.5 grams of Potassium Hydroxide and vacuum stripping the water of reaction, was reacted at 115° C. and 50 psi with 1061 grams of a 79/21 wt/wt mixture of Propylene Oxide and Dec-1-ene Oxide to a theoretical molecular weight of 1600. The catalyst was removed by treatment with Magnesol (Magnesium Silicate), vacuum stripping and filtration, to yield 1385 grams of an oil soluble polyalkylene glycol having the composition given below, and on which the following data were determined.

| | | |
|---|---|---|
| Composition | Secondary C-12/14 alcohol | 12.5 |
| | Propylene Oxide | 71.4 |
| | Dec-l-ene Oxide | 16.1 |
| Viscosity (ASTM D445) mPa.s @ 40° C. | | 94 |
| mPa.s @ 100° C. | | 15.8 |
| Viscosity Index (ASTM D2270) | | 180 |
| Four Ball Wear Scar, Neat (IP239) 1 Hour. 40 Kg, mm | | 0.50 |

Miscibility, Mineral Oil, BP Base Oil 150TQ (90% polyalkylene glycol, 10% oil, 25° C.) clear, complete solution (50% polyalkylene glycol, 50% oil, 25° C.) clear, complete solution.

BP Base Oil 80BHK (90% polyalkylene glycol, 10% oil, 25° C.) clear, complete solution (50% polyalkylene glycol, 50% oil, 25° C.) clear, complete solution.

EXAMPLE 6

320 Grams of Softanol AP30 (a 3 mole propoxylate of C-12/14 linear secondary alcohol manufactured by Nippon Shokubai Kagaku Kogyo Co Ltd) catalysed by adding 10.5 grams of Potassium Hydroxide and vacuum stripping the water of reaction, was reacted at 115° C. and 50 psi with 1392 grams of a 79/21 wt/wt mixture of Propylene Oxide and Dec-1-ene Oxide to a theoretical molecular weight of 2000. The catalyst was removed by treatment with Magnesol (Magnesium Silicate), vacuum stripping and filtration, to yield 1712 grams of an oil soluble polyalkylene glycol having the composition given below, and on which the following data were determined.

| | | |
|---|---|---|
| Composition | Secondary C-12/14 alcohol | 10.0 |
| | Propylene Oxide | 73.0 |
| | Dec-l-ene Oxide | 17.0 |
| Viscosity (ASTM D445) mPa.s @ 40° C. | | 120 |
| mPa.s @ 100° C. | | 19.7 |
| Viscosity Index (ASTM D2270) | | 187 |
| Four Ball Wear Scar, Neat (IP239) 1 Hour, 40 Kg, (mm) | | 0.52 |

Miscibility, Mineral Oil, BP Base Oil 150TQ (90% polyalkylene glycol, 10% oil, 25° C.) clear, complete solution (50% polyalkylene glycol, 50% oil, 25° C.) clear, complete solution.

EXAMPLE 7

111 Grams of Softanol AP30 (a 3 mole propoxylate of a C-12/14 secondary alcohol manufactured by Nippon Shokubai Kagaku Kogyo Co. Ltd), catalyzed by adding 2.6 grams of Boron Trifluoride Diethyletherate, was reacted at 65° C. and 50 psi pressure with 69 grams of Propylene Oxide then subsequently with 64 grams Dodec-1-ene Oxide to a theoretical molecular weight of 827. The catalyst was removed by treatment with Magnesol (Magnesium Silicate), filtration and vacuum stripping, to yield 234 grams (96%) of an oil soluble polyalkylene glycol with the composition below, and on which the following data were determined.

| | | |
|---|---|---|
| Composition | Secondary C-12/14 alcohol | 24.2 |
| | Propylene Oxide | 49.2 |
| | Dodec-l-ene Oxide | 26.6 |
| Viscosity (ASTM D445) mPa.s @ 40° C. | | 49.0 |
| mPa.s @ 100° C. | | 8.5 |
| Viscosity Index (ASTM D2270) | | 152 |
| Four Ball Wear Scar, Neat (IP239) 1 Hour, 40 Kg, (mm) | | 0.64 |

Miscibility, Mineral Oil BP Base Oil 150TQ (50% polyalkylene glycol, 50% oil, 25° C.) clear, complete solution.

EXAMPLE 8

69 Grams of Softanol AP30 (a 3 mole propoxylate of a C-12/14 secondary alcohol), catalyzed by adding 1.0 gram of Potassium Hydroxide and vacuum stripping the water of reaction, was reacted at 130° C. and 50 psi with 43 grams of Propylene Oxide, followed by 107 grams of n-Butylene Oxide, following by 81 grams of Dodec-1-ene Oxide to a theoretical molecular weight of 1624. The catalyst was removed by treatment with Magnesol (Magnesium Silicate), vacuum stripping and filtration, to yield 291 grams (97%) of an oil soluble polyalkylene glycol having the composition given below, and on which the following data were determined.

| | | |
|---|---|---|
| Composition (% wt) | Secondary C-12/14 alcohol | 12.3 |
| | Propylene Oxide | 25.0 |
| | Butylene Oxide | 35.5 |
| | Dodec-l-ene Oxide | 27.2 |
| Four Ball Wear Scar, Neat (IP239) 1 Hour, 40 Kg, (mm) | | 0.59 |

Miscibility, Mineral Oil, BP Base Oil 150TQ (50% polyalkylene glycol, 50% oil, 25° C.) clear, complete solution.

EXAMPLE 9

86.5 Grams of Dinonylphenol catalyzed by adding 1.5 grams of Potassium Hydroxide and vacuum stripping the water of reaction, was reacted at 130° C. and 50 psi with 130.5 grams of Propylene Oxide and subsequently with 55 grams of Dodec-1-ene Oxide to a theoretical molecular weight of 1089. The catalyst was removed by treatment with Magnesol (Magnesium Silicate), vacuum stripping and filtration, to yield an oil soluble polyalkylene glycol having the composition given below, and on which the following data were determined.

| | | |
|---|---|---|
| Composition (% wt) | Dinonylphenol | 31.8 |
| | Propylene Oxide | 47.9 |
| | Dodec-l-ene Oxide | 20.3 |
| Viscosity (ASTM D445) mPa.s @ 40° C. | | 166 |
| mPa.s @ 100° C. | | 17 |
| Viscosity Index (ASTM D2270) | | 110 |
| Four Ball Wear Scar, Neat (IP239) 1 Hour, 40 Kg, (mm) | | 0.65 |

Miscibility, Mineral Oil, BP Base Oil 150TQ (50% polyalkylene glycol, 50% oil, 25° C.) clear, complete solution.

EXAMPLE 10

189 Grams of Softanol AP30 (a 3 mole propoxylate of a C-12/14 secondary alcohol), catalyzed by adding 3.0 grams of Potassium Hydroxide and vacuum stripping the water of reaction, was reacted at 130° C. and 50 psi with 294 grams of Propylene Oxide and subsequently 111 grams of Dodec-1-ene Oxide to a theoretical molecular weight of 1175. The catalyst was removed by treatment with Magnesol (Magnesium Silicate), vacuum stripping and filtration to yield 572 grams (96%) of an oil soluble polyalkylene glycol with the composition below, and on which the following data were determined.

| | | |
|---|---|---|
| Composition (% wt) | Secondary C-12/14 alcohol | 17.0 |
| | Propylene Oxide | 64.2 |
| | Dodec-l-ene Oxide | 18.8 |
| Viscosity (ASTM D445) mPa.s @ 40° C. | | 71 |
| mPa.s @ 100° C. | | 12.4 |
| Viscosity Index (ASTM D2270) | | 175 |
| Four Ball Wear Scar, Neat (IP239) 1 Hour, 40 Kg, (mm) | | 0.50 |

Miscibility, Mineral Oil, BP Base Oil 150TQ (50% polyalkylene glycol, 50% oil, 25° C.) clear, complete solution.

EXAMPLE 11

76 Grams of Softanol AP30 (a 3 mole propoxylate of a C-12/14 linear secondary alcohol), catalyzed by adding 1,2 grams of Potassium Hydroxide and vacuum stripping the water of reaction, was reacted at 135° C. and 50 psi with 224 grams of Propylene Oxide and subsequently 75 grams of Dodec-1-ene Oxide to a theoretical molecular weight of 1844. The catalyst was removed by treatment with Magnesol (Magnesium Silicate), vacuum stripping and filtration to yield 360 grams (96%) of an oil soluble polyalkylene glycol with the composition below, and on which the following data were determined.

| | | |
|---|---|---|
| Composition (% wt) | Secondary C-12/14 alcohol | 10.8 |
| | Propylene Oxide | 69.2 |
| | Dodec-l-ene Oxide | 20.0 |
| Viscosity (ASTM D445) mPa.s @ 40° C. | | 51.1 |
| mPa.s @ 100° C. | | 11.0 |
| Viscosity Index (ASTM D2270) | | 214 |
| Four Ball Wear Scar, Neat (IP239) 1 Hour, 40 Kg, (mm) | | 0.52 |

Miscibility, Mineral Oil, BP Base Oil 150TQ (80% polyalkylene glycol, 20% oil, 25° C.) clear, complete solution (50% polyalkylene glycol, 50% oil, 25° C.) clear, complete solution.

EXAMPLE 12

160 Grams of Softanol AP30 (a 3 mole propoxylate of a C-12/14 linear secondary alcohol manufactured by Nippon Shokubai Kagaku Kaogyo Co. Ltd.), catalyzed by adding 3 grams of Potassium Hydroxide and azeotropically removing the water of reaction in 1000 grams of toluene, was reacted in the toluene at 130° C. and 50 psi with 710 grams of a 60/40 wt/wt mixture of Propylene Oxide and Hexadec-1-ene Oxide to a theoretical molecular weight of 2,100. The catalyst and solvent were removed by treatment with Magnesol (Magnesium Silicate), filtration and vacuum stripping to yield 846 grams (97%) of an oil soluble polyalkylene glycol having the composition given below, on which the following data were determined.

| | | |
|---|---|---|
| Composition (% wt) | Secondary C-12/14 alcohol | 9.5 |
| | Propylene Oxide | 57.7 |
| | Hexa-l-ene Oxide | 32.8 |
| Viscosity (ASTM D445) mPa.s @ 40° C. | | 66.7 |
| mPa.s @ 100° C. | | 12.5 |
| Viscosity Index (ASTM D2270) | | 189 |
| Four Ball Wear Scar, Neat (IP239) 1 Hour, 40 Kg, (mm) | | 0.65 |

Miscibility, Mineral Oil, BP Base Oil 150TQ (50% polyalkylene glycol, 50% oil, 25° C.) clear, complete solution.

EXAMPLE 13

109 Grams of Lincol 12/14 (a linear primary C-12/14 alcohol, manufactured by Condea Chemie GMBH), catalyzed by adding 3.7 grams of Potassium Hydroxide and azeotropically removing the water of reaction in 1000 grams of toluene, was reacted in the toluene at 130° C. and 50 psi with 980 grams of a 60/40 wt/wt mixture of Propylene Oxide and Hexadec-1-ene Oxide to a theory molecular weight of 2000. The catalyst and solvent were removed by treatment with Magnesol, filtration and vacuum stripping to yield 1060 grams (97%) of an oil soluble polyalkylene glycol with the composition below, on which the following data were determined.

| | | |
|---|---|---|
| Composition (% wt) | Primary C-12/14 alcohol | 10.0 |
| | Propylene Oxide | 55.0 |
| | Hexa-l-ene Oxide | 35.0 |

-continued

| | |
|---|---|
| Viscosity (ASTM D445) mPa.s @ 40° C. | 52 |
| mPa.s @ 100° C. | 10.6 |
| Four Ball Wear Scar, Neat (IP239) 1 Hour, 40 Kg, (mm) | 0.63 |

Miscibility, Mineral Oil BP Base Oil 150TQ (50% polyalkylene glycol, 50% oil, 25° C.) clear, complete solution.

EXAMPLE 14

433 Grams of Dinonylphenol, catalyzed by adding 8.5 grams of Potassium Hydroxide and azeotropically removing the water of reaction in 800 grams of toluene, was reacted in the toluene at 130° C. and 50 psi with 2065 grams of a 75/25 wt/wt mixture of Propylene Oxide and Dodec-1-ene Oxide to a theoretical molecular weight of 2000. The catalyst and solvent were removed by treatment with Magnesol (Magnesium Silicate), filtration and vacuum stripping to yield 2450 grams (98%) of an oil soluble polyalkylene glycol with the composition below, on which the following data were determined.

| | | |
|---|---|---|
| Composition (% wt) | Dinonylphenol | 17.3 |
| | Propylene Oxide | 62.0 |
| | Dodec-l-ene Oxide | 20.7 |
| Viscosity (ASTM D445) mPa.s @ 40° C. | | 154 |
| mPa.s @ 100° C. | | 20.2 |
| Viscosity Index (ASTM D2270) | | 153 |
| Four Ball Wear Scar, Neat (IP239) 1 Hour, 40 Kg, (mm) | | 0.65 |

Miscibility, Mineral Oil (BP Base Oil 150TQ)

(50% polyalkylene glycol, 50% oil, 25° C.) clear, complete solution.

EXAMPLE 15

300 Grams of an industrial gear lubricant were prepared by blending 290 grams of the oil soluble polyalkylene glycol from example 14 with 3 grams of a phenolic antioxidant, 5.5 grams of an aminic antioxidant and antiwear agent blend, and 1.5 grams of a sarcosine based anticorrosion agent. The following data were determined for the blend.

| | |
|---|---|
| Viscosity at 40° C. mPa.s | 170 |
| Four Ball Wear Scar, Neat (IP239) 1 hour, 40 Kg, mm | 0.37 |
| Miscibility, Mineral Oil (BP Base Oil 150TQ) (70% gear lubricant, 30% oil, 25° C.) | clear, complete solution |
| Four Ball Wear Scar, mixture with oil (IP239) 1 hour, 40 Kg, (mm) | 0.39 |

EXAMPLE 16 (COMPARATIVE EXAMPLE)

A polypropoxylate of butanol of molecular weight of 1740 (commercially available as Breox B125) is not oil soluble, with the following data.

| | | |
|---|---|---|
| Composition (% wt) | Butanol | 4.3 |
| | Propylene Oxide | 95.7 |

-continued

| | |
|---|---|
| Viscosity (ASTM D445) mPa.s @ 40° C. | 122 |
| mPa.s @ 100° C. | 21.3 |
| Viscosity Index (ASTM D2270) | 200 |
| Four Ball Wear Scar, Neat (IP239) 1 hour, 40 Kg, (mm) | 0.53 |

Miscibility, Mineral Oil (BP Base Oil 150TW)

(90% Breox B125, 10% oil, 25° C.) Mixture opaque, separates completely into 2 layers on standing for 1 hour (50% Breox B125, 50% oil, 25° C.) Mixture completely opaque, separates completely into 2 layers on standing for 1 hour.

I claim:

1. An industrial or automotive lubricating oil composition consisting essentially of (a) one or more mineral oils and (b) more than 60% by weight of a polyether having the general formula $$RX[(C_3H_6O)_n(C_yH_{2y}O)_pH]_m$$

wherein

R is either an alkyl or alkylphenyl group having from 9 to 30 carbon atoms

X is selected from O, S or N y is 6 to 30 m is 1 or 2 n and p are integers such that the polyether contains between 1 and 35% by weight of $(C_yH_{2y}O)$ units and between 35 and 80% by weight of $(C_3H_6O)$ units.

2. An industrial or automotive lubricating oil as claimed in claim 1 characterised in that the polyether contains between 9 and 25% by weight of $(C_yH_{2y}O)$ units and between 50 and 80% by weight of $(C_3H_6O)$ units.

3. An industrial or automotive lubricating oil as claimed in claim 2 characterised in that y is 12 to 16.

4. An industrial or automotive lubricating oil as claimed in claim 3 characterised in that R is selected from either alkyl groups having from 12 to 18 carbon atoms or alkylphenyl groups having from 9 to 24 carbon atoms.

5. An industrial or automotive lubricating oil as claimed in claim 1 characterised in that the molecular weight of the polyether is in the range 400 to 4000 and the viscosity of the polyether is in the range 32–460 mPa.s at 40° C.

6. An industrial or automotive lubricating oil as claimed in claim 1 wherein the polyether units $(C_yH_{2y}O)$ and $(C_yH_{2y}O)_p$, respectively are made up of one or more different alkylene oxides.

7. An industrial or automotive lubricating oil as claimed in claim 1 characterised in that, in the polyether, R is an alkyl or alkylphenyl group having from 10 to 30 carbon atoms, n is 5 to 30 and p is 1 to 4.

8. A process for preparing an industrial or automotive lubricating oil as defined in claim 1 characterised by blending mineral oils with more than 60% by weight of a polyether as defined in claim 1.

9. A process for lubricating the moving parts of industrial gears or of automobiles characterised by applying an industrial or automotive lubricating oil as defined in claim 1 to the moving parts.

* * * * *

UNITED STATES PATENT AND TRADEMARK OFFICE

CERTIFICATE OF CORRECTION

PATENT NO. : 5,143,640

DATED : September 1, 1992

INVENTOR(S) : JOHN R. MOXEY

It is certified that error appears in the above-identified patent and that said Letters Patent is hereby corrected as shown below:

In the Abstract, line 6, correct the expression to read --$_{2y}O)_pH]_m$--.

Col. 8, l. 69, correct the compound to read-Hexadec-1-ene Oxide--

Col. 4, line 63, add line reading, "Miscibility, Mineral Oil 25°C"

Signed and Sealed this

Second Day of November, 1993

Bruce Lehman

*Attest:*

BRUCE LEHMAN

*Attesting Officer*

*Commissioner of Patents and Trademarks*